United States Patent [19]

Gennari

[11] 4,074,618

[45] Feb. 21, 1978

[54] PROCESS AND APPARATUS FOR GLUEING CARTON BODIES

[75] Inventor: Luigi Gennari, Cremona, Italy

[73] Assignee: Kartocol Anstalt, Vaduz, Liechtenstein

[21] Appl. No.: 661,039

[22] Filed: Feb. 24, 1976

[30] Foreign Application Priority Data

Mar. 4, 1975 Switzerland ..... 2821/75

[51] Int. Cl.[2] ..... B31B 1/26

[52] U.S. Cl. ..... 93/49 M; 93/49 R; 93/94 PS

[58] Field of Search ..... 93/49 R, 49 M, 94 PS, 93/36 R, 52, 82

[56] References Cited

U.S. PATENT DOCUMENTS

| | | | |
|---|---|---|---|
| 3,124,914 | 3/1964 | Eissmann et al. | 93/49 R X |
| 3,444,792 | 5/1969 | Thesing et al. | 93/94 PS |
| 3,564,981 | 2/1971 | Von Arland et al. | 93/94 PS X |
| 3,800,677 | 4/1974 | Jones et al. | 93/49 R X |
| 3,908,526 | 9/1975 | Vassalos | 93/94 PS X |

*Primary Examiner*—Roy Lake
*Assistant Examiner*—Paul A. Bell
*Attorney, Agent, or Firm*—Finnegan, Henderson, Farabow & Garrett

[57] ABSTRACT

The invention relates to a process for glueing carton bodies, wherein the carton is fed in its extended condition and caused to wrap around a form having the shape of the erected and assembled carton body by means of suitable guides, until the carton body is closed by joining the side with the opposite end flap with glue, sliding the closed carton body along said form while keeping the said body pressed against said form through the guide and sliding means for sufficient length and time to provide for the adhesion setting between the glued flaps, and then discharging the carton from the form in such a way as to have the body thereof glued and in an erected, open and assembled position, ready to be fed to the carton filling and closing line.

The invention relates also to an apparatus for carrying out said process, comprising means feeding the extended cartons, guide means for moving the cartons to a wrapping position, means for applying adhesive onto a carton flap, a form having the shape of the erected and assembled carton body, means for closing and joining the carton body around the form, means for sliding the carton body along the form, means for discharging the assembled carton body from the apparatus and control means for controlling the movable members of the apparatus.

11 Claims, 4 Drawing Figures

27
F
P 7
P 8
P 9
E
P 6
31
33
32
P 10
34
36
E
E
P 5
P 11
37
D
E
P 4
P 12
35
B
C
A
E
P 1
33
D
E
P 2
P 3
P 13
T

PROCESS AND APPARATUS FOR GLUEING CARTON BODIES

BACKGROUND OF THE INVENTION

1. Field of the Invention

The present invention relates to a process and an apparatus for glueing carton bodies, such as parallelepipedal cartons.

2. Description of Prior Art

At present the cardboard industries after the steps of diecutting and printing the extended cartons, also provide for the glueing of the carton body and supply collapsed folded cartons, with the body thereof glued along its side, to the users. The industries using such cartons have then to provide for operations such as box erection, bottom closure and glueing, filling of the box with the product to be packed, e.g. detergent powders, foodstuffs and any other type of loose product which is to be packed in boxes, and finally closure and glueing of the cover.

In order to increase the production of cartons, increasingly large, expensive and fast machines for glueing carton bodies have been provided which are now as long as several meters and require considerable labour. Furthermore storage and transport for the collapsed cartons having the bodies thereof already glued, require expensive and accurate packing in heavy cases, this being space consuming and requiring capital investments. Finally, the existing machinery folds the carton score lines several times, thus weakening the resistance of the carton body which during the entire movement through this machinery is never wrapped in its fully closed condition around a form having the final shape of the carton body.

The existing state of the art thus provides the division of the glueing operations into two discrete stages, viz. glueing of the body which is implemented by the carton manufacturer and glueing of bottom and cover carried out by the user.

SUMMARY OF THE INVENTION

Thus, the present invention tackles the problem of providing a process and an apparatus by which the carton body is glued as an operation prior to the packaging, and glueing is carried out by the user and no more by the cardboard industry which produces the carton. This novel concept allows the drawbacks and the considerable costs of the systems used at present to be avoided, in that the cartons can be stored and transported in the extended condition, after the die-cutting and printing steps, thus eliminating the expensive and cumbersome packages as well as the expensive and large glueing machines which the cardboard industries are now forced to use, and further providing a stronger carton which is not weakened by the folds of the body scoring.

The process for glueing carton bodies according to the present invention is characterized by the carton being fed in its extended condition and caused to wrap around a form having the shape of the erected and assembled carton body by means of suitable guides until said carton body is closed by joining the side with the opposite end flap with glue, sliding the closed carton body along said form while keeping the said body pressed against said form through guide and sliding means for sufficient lenght and time as to provide for the adhesion setting between the glued flaps, and then discharging the carton from the form in such a way as to have the body thereof glued and in an erected, open and assembled position, ready to be fed to the carton filling and closing line.

The apparatus for glueing carton bodies according to the present invention is characterized in that it comprises means feeding the extended cartons, guide means for moving the cartons to a wrapping position, means for applying adhesive onto a carton flap, a form having the shape of the erected and assembled carton body, means for closing and joining the carton body around the form, means for sliding the carton body along the form, means for discharging the assembled carton body from the apparatus and control means for controlling the movable members of the apparatus.

BRIEF DESCRIPTION OF THE DRAWINGS

The features and advantages of the process as well as the apparatus for the implementation thereof will become more apparent in the light of the following detailed description of a preferred embodiment thereof, given by way of non-limiting example, reference being made to the annexed illustrative drawings, in which.

DETAILED DESCRIPTION OF THE PREFERRED EMBODIMENTS

Figure 1:
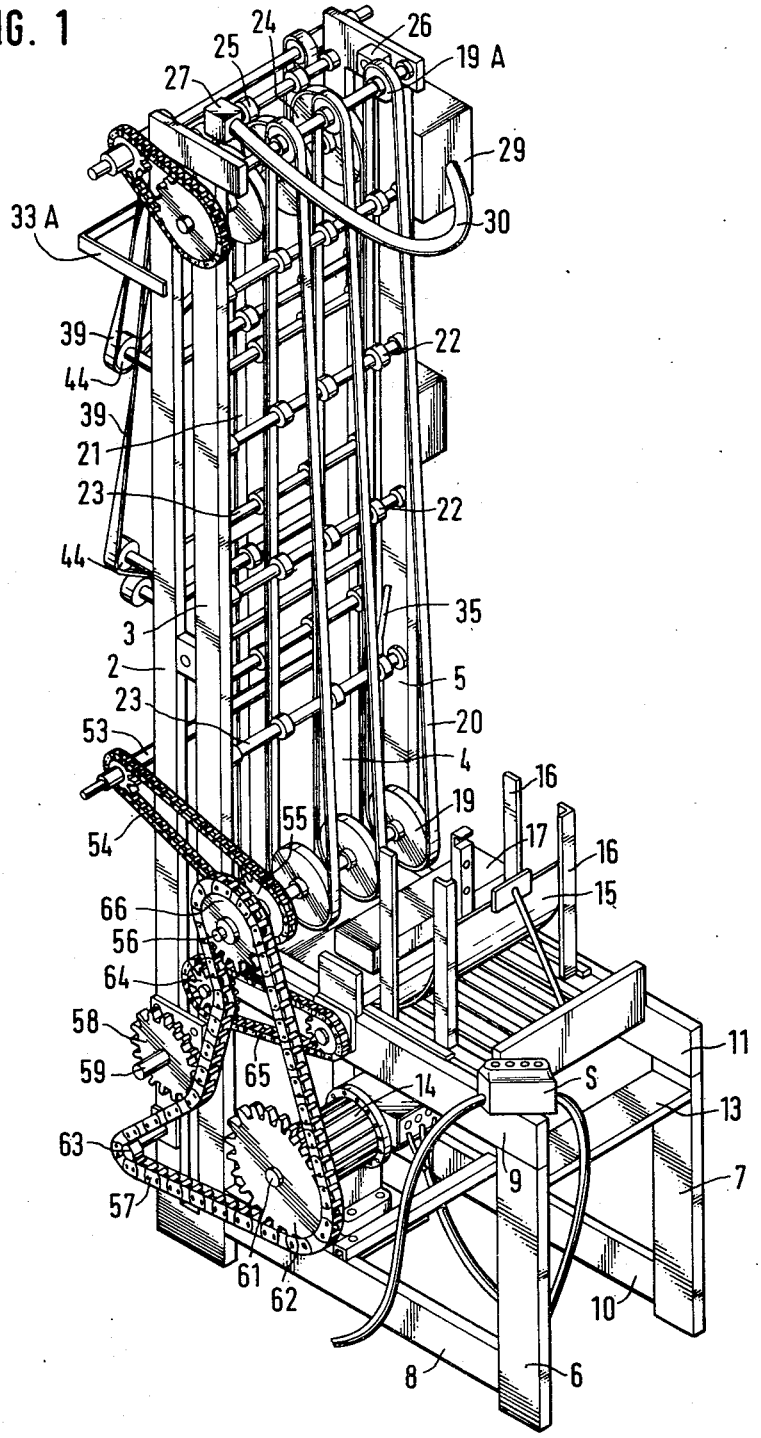
FIG. 1 is a view of the apparatus for glueing carton bodies according to the present invention, taken from the feed side of the extended cartons.

Referring first to FIG. 1, the feed side of the illustrative apparatus for carrying out the process of the present invention will now be described. The apparatus is mainly intended for installation at the starting end of a packaging line, such as an already existing one, and for such reason the apparatus itself has been designed for a substantially vertical arrangement although it is apparent that it can as well have a horizontal arrangement, that is having the form around which the carton bodies wrap and close, positioned horizontally rather than vertically. The vertical apparatus, however, is more advantageous also in that it discharges the cartons, with the body thereof glued, already arranged in an upstanding position and therefore ready for the subsequent filling and closing steps which are performed by the packaging line.

The apparatus according to the present invention substantially comprises a frame provided by a pair of twin vertical columns 2, 3 and 4, 5 and a table which, in its turn, is comprised of two posts 6, 7 connected to the columns by longitudinal members 8, 9, 10, 11 and between each other by cross members 12, 13. Between the lower longitudinal members 8, 9 there is provided a motor 14 which drives in synchronism all the movable members of the apparatus through suitable transmissions which will be described more in detail hereinafter.

On the upper surface of the table there is provided a magazine or loading member for the extended die-cut cartons 15 placed within a cage comprised of posts 16, from which magazine the cartons are drawn one at a time through a feeder device which is generally indicated by 17 and will not be described more in detail as it can be of any conventional type.

The feeder device 17 feeds the carton which is drawn from the stack in the magazine, onto a plurality of short conveying belts 18 ending under lower pulleys 19 of a plurality of vertical conveying belts 20 ending on upper pulleys 19A and which in the upward run are positioned opposite a corresponding plurality of like centre conveying belts 21.

Belts 20 and 21 are held pressed to each other by several series of pressure rollers 22 idly fitted on several shafts 23 mounted on the frame posts.

Figure 2:
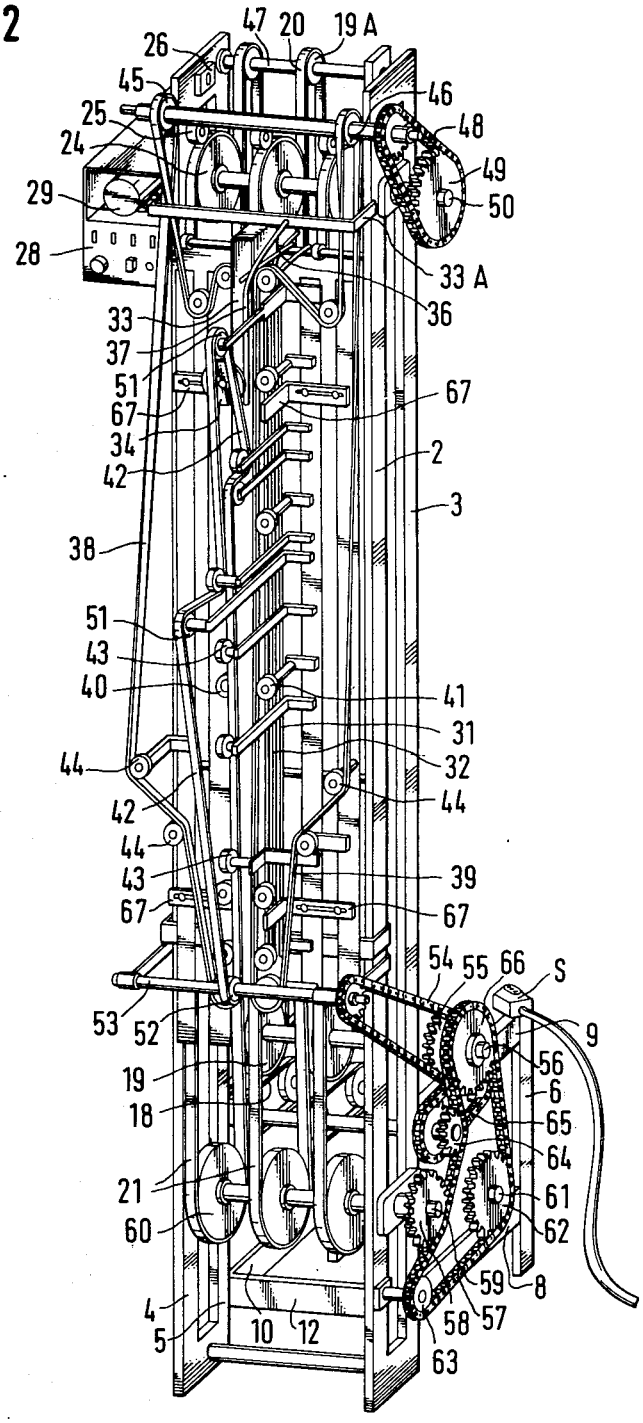
FIG. 2 is a view of the apparatus of FIG. 1, taken from the side incident to the closure of the carton body and the discharge thereof.
Figure 3:
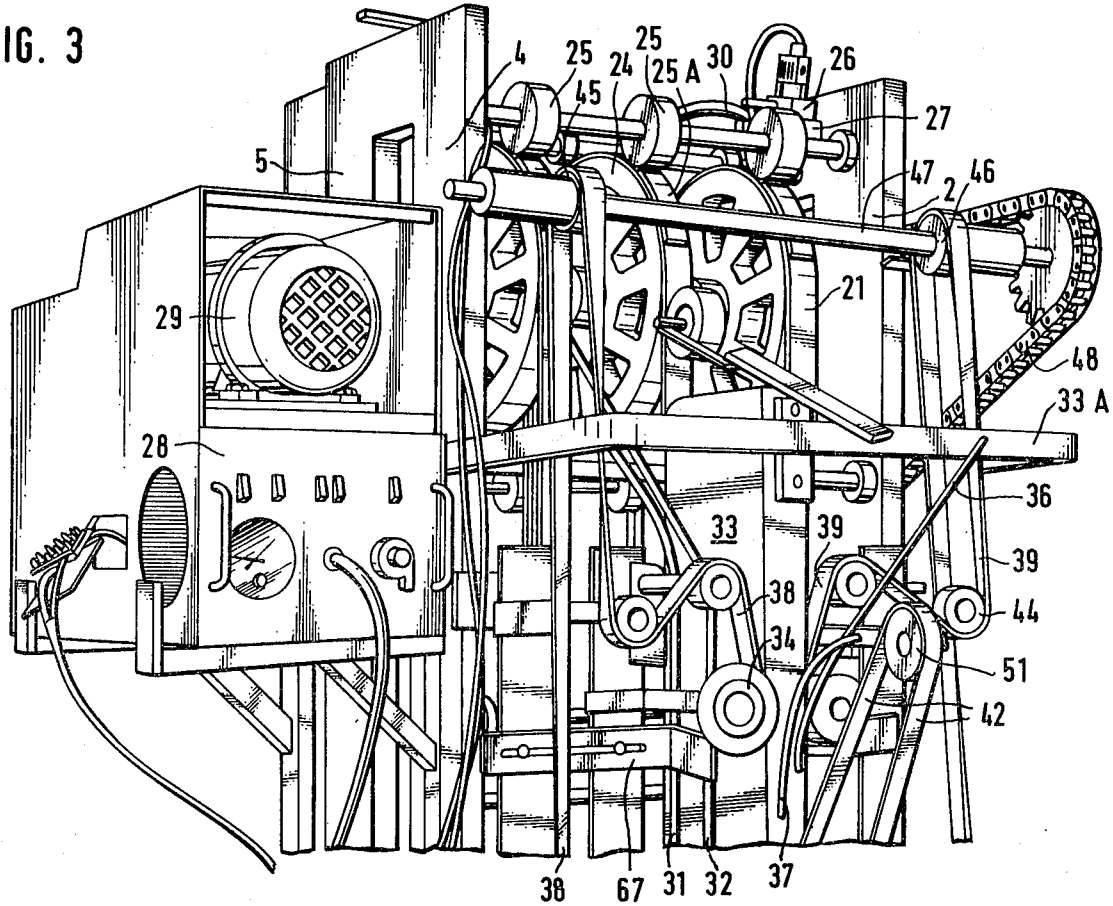
FIG. 3 is an enlarged view of the apparatus head, illustrating in particular glueing, guide and closing means for the carton body.

Thus, the extended cartons are moved one at a time upwardly, driven by belts 20 and 21 therebetween, until they reached the upper head of the apparatus, said upper head providing one of the essential parts of the system now to be described in detail with reference to FIGS. 1, 2 and 3 at the same time.

Upon reaching upper pulleys 24 of centre belts 21, the cartons are moved towards the opposite side of the machine, being caused to follow the curve of pressure rollers 25 by curved guides 25A. On passing over the upper head of the machine, a photoelectric cell or like device 26, functions to detect a carton arrival and to control the adhesive delivery from an adhesive supply member 27 placed on the opposite side of the head. The photoelectric cell 26 is a part of an electronic unit 28 which is also adapted for counting the cartons passing cell 26 and at the same time it controls compressor 29 which blows pressurized air to supply member 27 through a conduit 30 to cause said supply member 27 to apply a strip of adhesive onto the carton passing over the apparatus head.

Figure 4:
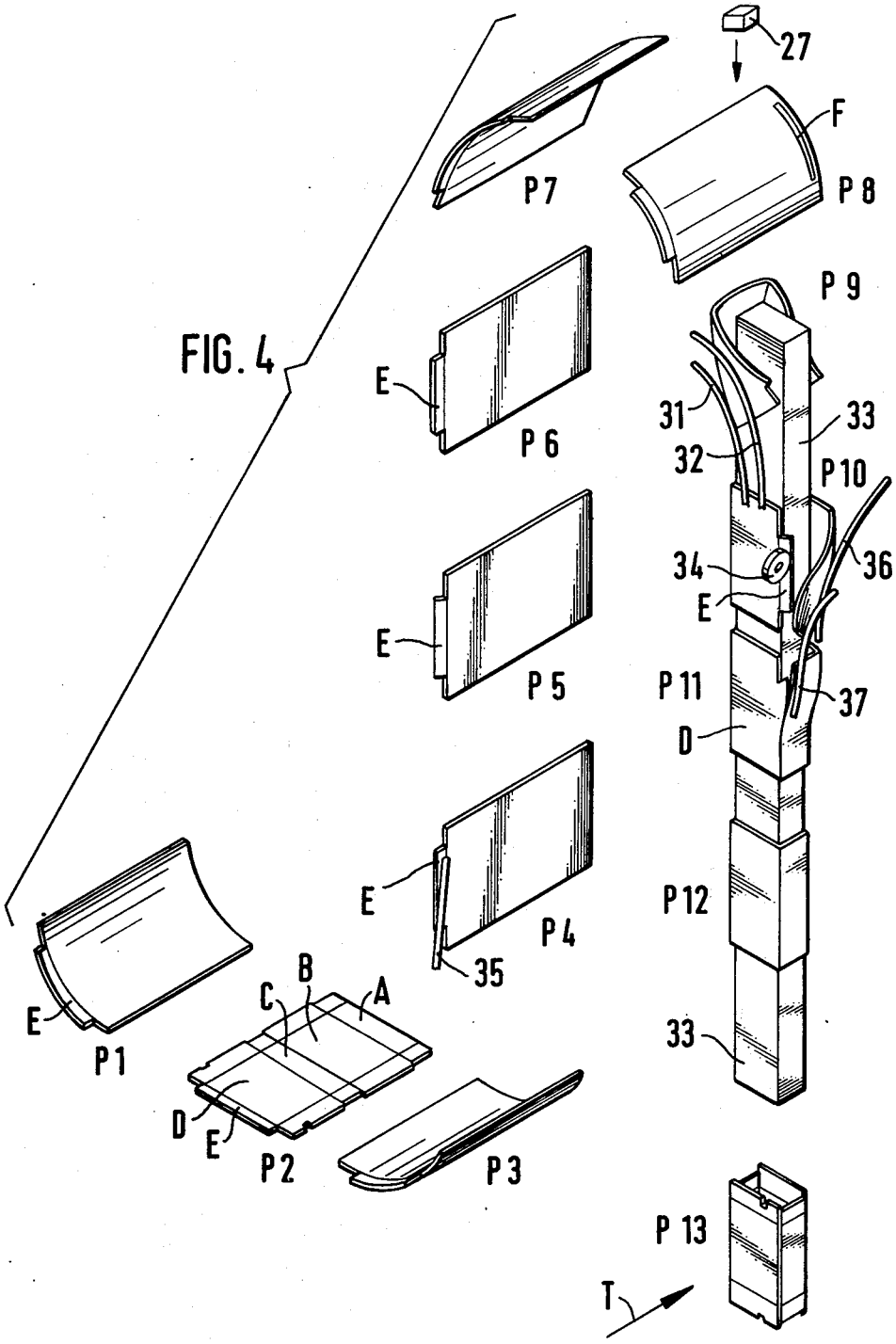
FIG. 4 is a perspective diagram of the operative sequence carried out by the apparatus according to the present invention on a carton.

As can be seen from FIG. 4, the adhesive is applied onto area F of the carton upper face, at flap A, which during the closing step for the carton body, moves to position itself over tab E thereby joining therewith. This process differs from that being followed in the existing glueing machines in use in cardboard industries, where the adhesive is rather applied onto the outer face of tab E.

The adhesive which is preferably used in the glueing operation, in the apparatus and process according to the present invention is of the so called "hot-melt" type, that is quick melting and setting, so as not to drool and in order to provide the joining of the carton flaps together during the travel thereof over the wrap form.

After the adhesive application, the carton is positioned, at the beginning of the downward run on the carton closing and discharge side of the apparatus. As can be seen from FIGS. 2 and 3, and as illustrated in the operative sequence of FIG. 4, the carton mates with guide bars 31, 32 on the two sides thereof which cause the carton to rise sideways to slip in a frusto-conical shape over a form 33, which has the same shape as the erected and assembled carton body, and which is so long as to allow a perfect adhesive setting and the body closure during the time the carton takes to move down to the bottom of the form itself. Form 33 is secured to the apparatus posts by an upper cross member 33A.

Form 33, in this preferred embodiment of the apparatus, is parallelepipedal, but might as well have a triangular, polygonal or cylindrical shape, in order to close carton bodies having such forms, although the process and apparatus have been particularly designed for parallelepipedal containers.

As the apparatus according to the present invention will be basically used by industries packaging products to be boxed, form 33 will generally be fixed, because packaging undustries very seldom change format and/or shape of their boxes, but it is apparent that form 33 may also be removable and interchangeable, so that the same apparatus can be used for glueing carton bodies having different formats and/or shapes.

Upon sliding downward over form 33, the carton almost simultaneously meets a disc 34 which bends tab E of the body over the front face of form 33—which tab E had already been bent once by a guide 35 during the upward travel in order to make the score line thereof more yielding — and two successive front guide rods 36 and 37 which force flap A to close upon the front wall of the form and to overlap tab E which will then mate with and join portion F of flap A where the adhesive has been applied, thus immediately closing and fixedly securing the carton body.

The two main walls B and D of the carton body (see FIG. 4) are held pressed by two endless side belts 38 and 39 which, in turn are held adherent to form 33 by a plurality of idle pressure rollers 40 and 41, whereas flap A is held under pressure by a like front endless belt 42, which also runs under a pressure roller 43, while the opposite flap C is held pressed against the form by the centre belt being one of centre conveying belts 21 which are also used to convey the cartons upwards. Besides side belts 38 and 39, walls B and D are kept adherent to form 33 by guide bars 31, 32 which extend downwards therealong.

Side belts 38, 39 complete their loop around guide rollers 44, and are driven by driving pulleys 45, 46 respectively, which are integral with a shaft 47 to which motion is imparted through a chain 48 and a sprocket wheel 49, by shaft 50 to which upper pulleys 24 of centre belts 21 are fitted, whereas front belt 42, also running over several guide rollers 51, is driven by drive pulley 52 fitted to shaft 53 driven by chain 54 to which motion is imparted by sprocket wheel 55 splined on shaft 56 of lower pulleys 19 of vertical conveying belts 20.

It is now convenient to complete the description of the tranmission system and specify that centre belts 21 are, in turn, driven by main driving chain 57 which actuates sprocket wheel 58 splined on shaft 59 of lower pulleys 60 of said centre belts 21. The main drive chain 57 receives motion direct from output shaft 61 of motor 14 through sprocket wheel 62, runs over guide sprocket 63, drives said sprocket wheel 58 controlling centre belts 21, then runs around a sprocket 64 which is splined on the same shaft driving, through an additional chain 65, short belts 18 which convey the cartons at the outlet of feeder 17, then it moves sprocket wheel 66 splined on said shaft 56 which drives lower pulleys 19 of vertical conveying belts 20 and at the same time front belt 42 in the already disclosed manner and it finally completes its loop again at sprocket wheel 62.

As described above, form 33 can be fixed, in which case also all supports for various pressure rollers 40, 41 and 43 and guide bars 31 and 32 are fixed, but if form 33 is interchangeable, then said supports shall be movable so as to be adjustable to the type of form fitted to the apparatus. By way of example supports 67 for guide bars 31 and 32 are shown slidable.

At the lower end of form 33 the glued, closed, assembled and erected carton bodies will come out ready to be moved, by any suitable means, to the starting point of the packaging line for the products to be boxed, such bodies already being in an upstanding position with the various bottom and cover flaps in the open condition and ready for the glueing and closure. The assembled carton body conveyance, from the apparatus of the present invention to the packaging line, is schematically indicated by arrow T in FIG. 4.

The operations performed by the apparatus according to the present invention are schematically illustrated in FIG. 4. From the magazine for the extended cartons (position $P_1$) feeder 17 draws a carton at a time which is transferred by short conveying belts 18 (position $P_2$) to and underneath lower pulleys 19 (position $P_3$) wherefrom it rises upwards while being pressed by belts 20 and 21 therebetween. During this upward travel, tab E is bent a first time by guide 35 (position $P_4$), then it returns to the extended position (positions $P_5$ and $P_6$). Upon arrival to the upper head, the carton bends forward (position $P_7$) passes underneath the adhesive applying device 27, bends downward with the adhesive strip F applied to flap A (position $P_8$), starts wrapping around form 33 because of guide bars 31 and 32 (position $P_9$), tab E is folded by disc 34 against form 33 and simultaneously front guide rod 36 initiates the final closing of the body (position $P_{10}$) said closing being completed by the next front guide 37 which causes flap A, with the revelant portion F covered with adhesive, to adhere to flap E (position $P_{11}$), then the carton body, thus closed and glued, slides downward onto form 33 (position $P_{12}$), from the lower end of which the carton is discharged and conveyed towards the packaging line (position $P_{13}$). The control buttons of the apparatus can be arranged in a control box 5 arranged either in a suitable position on the machine or in a remote position, according to the requirements of the different plants.

Obviously, in the various parts of the apparatus according to the present invention many modifications, adjustments, additions and substitutions can be made without departing from the spirit or the scope thereof.

A possible important variation in the process consists of feeding the carton with the adhesive already applied to the flap thereof, which adhesive is activated or softened at the moment corresponding to the photoelectric detection for the passing carton. In this case the supply device 27 will be replaced by a device activating the adhesive, and still controlled by the photocell 26.

I claim:

1. A method of fabricating a carton open at its opposite ends including:

providing a plurality of planar carton blanks, disposing a plurality of blanks in a horizontal stack, conveying carton blanks one after the other along a predetermined path, disposing the carton blanks one after the other about a substantially vertically disposed elongated form forming a portion of said path including displacing the cartons one by one from the stack and transporting each blank in a substantially vertically upward direction, and reversing the direction of travel of each blank after transport in the vertically upward direction for movement in a substantially vertically downward direction about the form, said form having the cross-sectional shape of the fabricated open ended carton, wrapping each carton blank about the form, overlapping opposed side flaps of each carton blank one over the other along one side of the form to close the blank about the form, gluing the overlapped side flaps of each carton one to the other, displacing the closed carton blank substantially vertically along the form, maintaining the sides of the closed carton blank against the form as the closed carton blank is displaced therealong, and discharging the open-ended carton from the form in a substantially vertical orientation with the opposite ends thereof opening vertically.

2. The method according to claim 1 including applying glue to one of the flaps.

3. The method according to claim 1 including bending one of the flaps of each blank during movement thereof in the vertically upward direction to prepare such flap for final folding.

4. The method according to claim 1 including photoelectrically detecting the arrival of a carton blank at a predetermined location along said path and providing an output signal in response thereto, and applying glue to one of the side flaps of a carton blank in response to said signal.

5. The method according to claim 1 including bending one of the flaps of each blank during movement thereof in the vertically upward direction to prepare such flap for final folding, photoelectrically detecting the arrival of a carton blank at a predetermined location along said path and providing an output signal in response thereto, and applying glue to one of the side flaps of a carton blank in response to said signal.

6. Apparatus for fabricating a carton having open opposite ends comprising:

a frame, means carried by said frame for storing a plurality of planar carton blanks having opposed side flaps, means for removing said blanks from said storing means one after the other, a first substantially vertical conveyor for moving each blank removed from said storing means in a substantially vertically upward direction, means for substantially reversing the direction of movement of each blank at the upper end of said first conveyor, a substantially elongated vertically disposed form having a cross-sectional shape corresponding to the cross-sectional shape of the fabricated open-ended carton, a second substantially vertical conveyor for conveying said blanks along said form, means carried by said frame for closing the planar carton blank laterally about said form, means carried by said frame for displacing said flaps such that one flap overlaps the other flap, means carried by said frame for at least in part securing said flaps one to the other, and means for receiving said closed carton blank with its open opposite ends extending in a vertical direction after said closed carton blank has been displaced the full length of said form.

7. Apparatus according to claim 6 wherein a portion of said first vertical conveyor forms a portion of said second vertical conveyor.

8. Apparatus according to claim 6 including means adjacent the upper end of said first conveyor for applying glue to one of said flaps.

9. Apparatus according to claim 6 including means adjacent said first conveyor for prefolding one of said flaps to render said one flap yieldable.

10. Apparatus according to claim 6 wherein a portion of said first vertical conveyor forms a portion of said second vertical conveyor, means adjacent the upper end of said first conveyor for applying glue to one of said flaps, and means adjacent said first conveyor for prefolding one of said flaps to render said one flap yieldable.

11. Apparatus according to claim 6 including means for photoelectrically detecting the arrival of each carton blank adjacent the upper end of said first conveyor and providing an output signal in response thereto, and means responsive to said signal to actuate said glue applying means to apply glue to one of said flaps.

* * * * *